US006431902B1

(12) United States Patent
Yeh

(10) Patent No.: US 6,431,902 B1
(45) Date of Patent: Aug. 13, 2002

(54) ELECTRICAL CONNECTOR HAVING AN IMPROVED LATCH MECHANISM

(75) Inventor: Joel J. Yeh, San Gabrie, CA (US)

(73) Assignee: Hon Hai Precision Ind. Co., Ltd., Taipei Hsiena (TW)

( * ) Notice: Subject to any disclaimer, the term of this patent is extended or adjusted under 35 U.S.C. 154(b) by 0 days.

(21) Appl. No.: 09/955,265

(22) Filed: Sep. 10, 2001

(51) Int. Cl.[7] ..... H01R 13/54
(52) U.S. Cl. ..... 439/358; 439/188
(58) Field of Search ..... 439/358, 357, 439/350, 352, 353, 188

(56) References Cited

U.S. PATENT DOCUMENTS 5,797,771 A * 8/1998 Gauside ..... 439/358
6,254,417 B1 * 7/2001 Pan ..... 439/350
6,257,914 B1 * 7/2001 Comerci et al. ..... 439/357
6,290,530 B1 * 9/2001 Chang ..... 439/357

* cited by examiner

*Primary Examiner*—Hien Vu
(74) *Attorney, Agent, or Firm*—Wei Te Chung

(57) ABSTRACT

An electrical connector (1) comprises a top cover (10), a bottom cover (20), a terminal module (30) having a plurality of terminals (31) received therein, a print circuit board (PCB) (40) with a switch (50) soldered thereon, a latching piece (60), a metal plate (70) and a strain relief (80). The top cover defines a press button (11) and a latch release button (14). The latching piece is assembled to the terminal module and has a pair of latch arms (63), a pair of transition portion (64) at the ends of the latch arms and perpendicular to the latch arms, a pair of latches (61) at the other ends of the transition portion for engaging with a mating connector and a pair of hooks (65) extending from two edges of the two latch arms respectively. By forcing the press button, the latch release button moves downwardly to drive the two hooks and the latches to release from the mating connector.

2 Claims, 8 Drawing Sheets

ELECTRICAL CONNECTOR HAVING AN IMPROVED LATCH MECHANISM

FIELD OF THE INVENTION

The present invention relates to electrical connectors, and more particularly to electrical connectors for personal digital assistants (PDAs). The electrical connectors have specific applicability to latching systems.

BACKGROUND OF THE INVENTION

Portable communication devices, such as cellular telephones, pagers, personal digital assistants (PDAs), etc., have become popular in recent years. Being portable, such devices frequently need to be charged, or connected to other devices, such as personal computers to upload or download information. Such a portable communication device is connected to an external device via an electrical connector. The electrical connector for the above portable device has a latching mechanism. The latching mechanism includes a pair of latch arms and a push button connecting the latch arms. Each latch arm has a hole for positioning the latching mechanism on a housing and a latch pawl at its end for intermating with a mating connector. The push button extends through an opening in a top cover of the electrical connector. In order to separate the electrical connector from the mating connector, a user presses the push button to actuate the latch arms to move downwardly, which leads the latch pawls to move downwardly. When the push button is released, the latch arms return to their original position, with the latch pawls spring backwardly from the mating connector.

However, in the above prior design, the latch arms are at the same level, so the release function of the latching mechanism is laborious and not beneficial to the operating life of the latch mechanism or the electrical connector. Also, the latch mechanism is positioned on the housing by the notches, so the housing needs a complex structure to mate the notches.

Hence, an improved connector latch mechanism is required to overcome the disadvantages of the prior art.

SUMMARY OF THE INVENTION

Accordingly, the primary object of the present invention is to provide an electrical connector, with its latch mechanism having a laborsaving release function and a prolonging operating life. The latch mechanism can be firmly positioned on a housing without adding to complexity of the housing.

An electrical connector in accordance with the present invention, comprises a top cover, a bottom cover, a terminal module having a plurality of terminals received therein, a print circuit board (PCB) with a switch soldered thereon, a latching piece, a metal plate and a strain relief. The top cover defines a press button and a latch release button. The latching piece assembled to the terminal module comprises a pair of latch arms, a pair of hooks extending from two edges of the two latch arms respectively, a pair of transition portions perpendicularly to the latch arms respectively, a pair of latches at each end of the transition portion for engaging with a mating connector and a crimping at a rear end of the latch arms for securing a cable. During operation, the press button is depressed and the latch release button moves downwardly to drive the two hooks move downwardly. When the press button is released, the latches release from a mating connector.

Other objects, advantages and novel features of the invention will become more apparent from the following detailed description when taken in conjunction with the accompanying drawings.

DETAILED DESCRIPTION OF THE INVENTION

Figure 1:
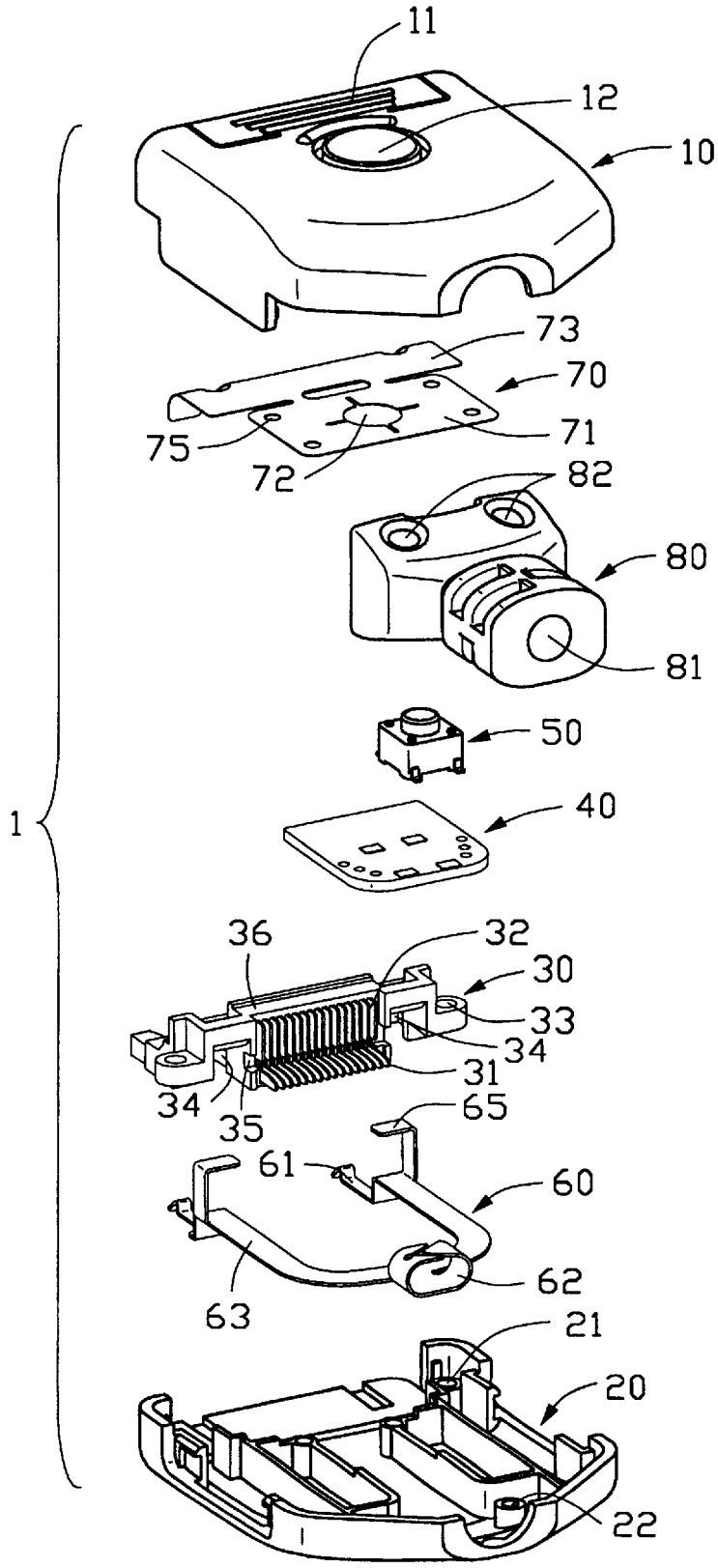
FIG. 1 is an exploded view of an electrical connector in accordance with the present invention.
Figure 2:
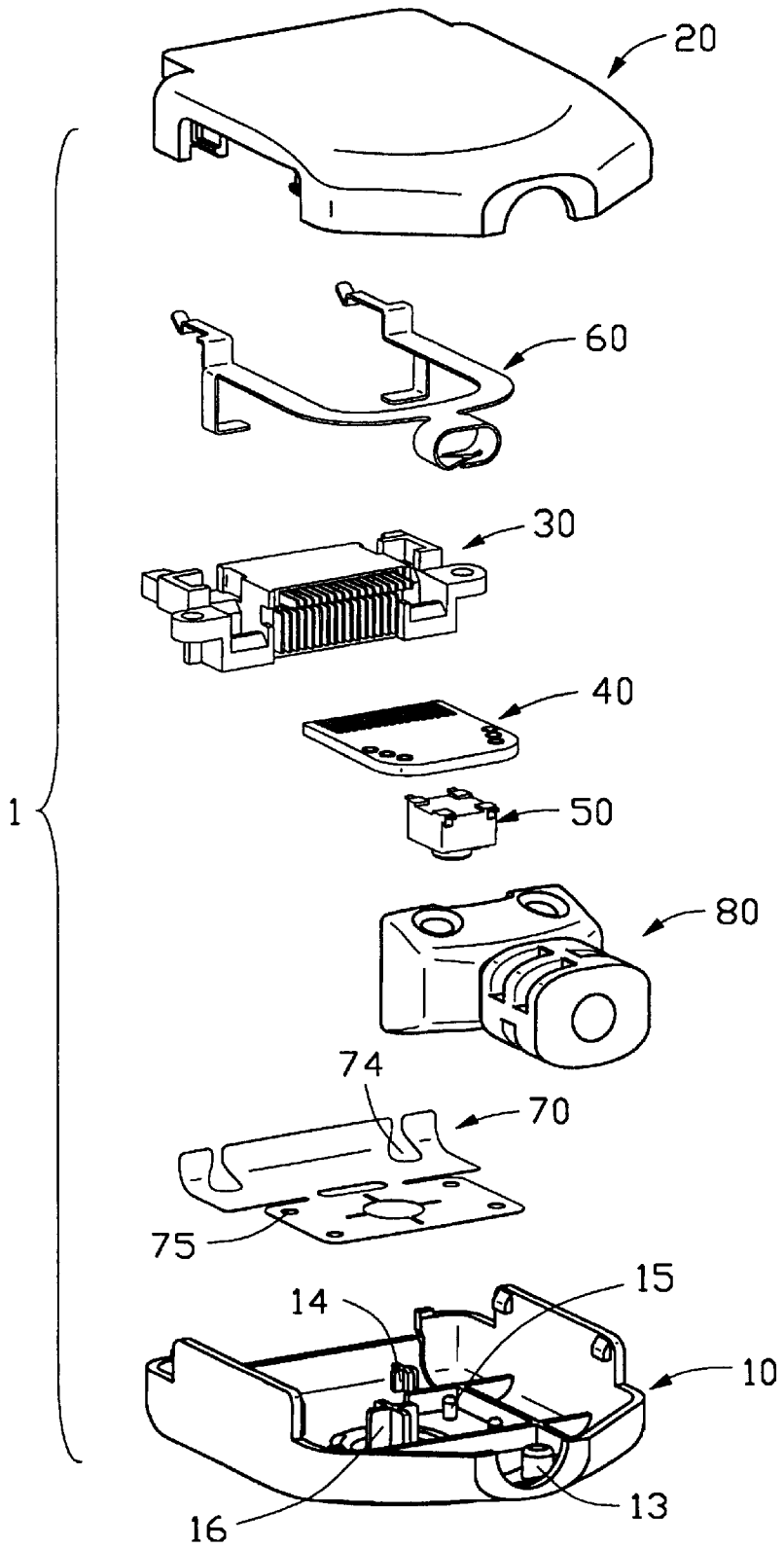
FIG. 2 is similar to FIG. 1, but taken from another angle of view.

Referring to FIGS. 1 and 2, an electrical connector 1 in accordance with the present invention comprises a top cover 10, a bottom cover 20, a terminal module 30 having a plurality of terminals 31, a print circuit board (PCB) 40 with a switch 50 soldered thereon, a latching piece 60, a metal plate 70, and a strain relief 80.

The top cover 10 has a press button 11 at a front end thereof and a push button 12 located in the middle portion thereof. The top cover 10 further comprises a central pole 16 under the push button 12, a plurality of position poles 15 surrounding the central pole 16, a pair of latch release button 14 protruding under the press button 11, a pair of upper poles 13 near a rear end and formed on a lower surface thereof. The bottom cover 20 defines a pair of lower notches 21 at a front end therein and a pair of lower poles 22 at a rear end thereof. The terminal module 30 defines a housing 36 and a plurality of terminals 31 received in a plurality of channels 32, the housing 36 has a pair of cutouts 35 for retaining a PCB 40, a pair of channels at the sides of the housing 36 and a pair of upper notches 33 at the outboards of the housing 36. The metal plate 70 defines a base portion 71 and a bent portion 73, the base portion 71 defines a central hole 72 and a plurality of position poles 75 surrounding the central hole 72, and the bent portion 73 has a pair of cavities 74. The strain relief 80 defines a through-hole 81 for receiving an end of a cable and a pair of notches 82 through top-to-bottom corresponding to the upper poles 13 and the lower poles 22.

Figure 3:
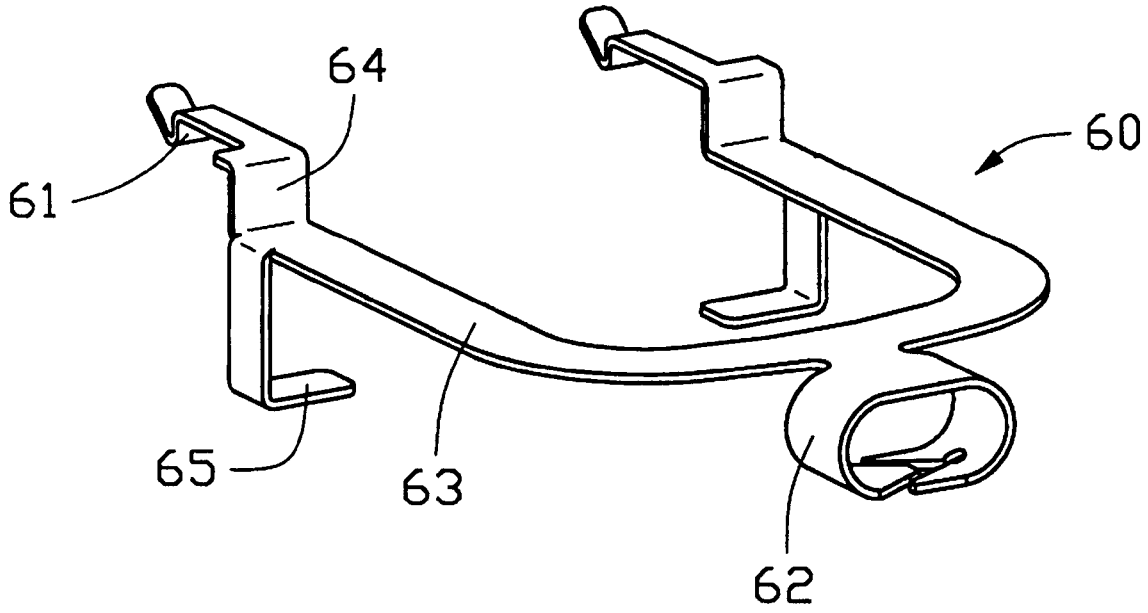
FIG. 3 is a perspective view of a latching piece of the electrical connector.

Referring to FIG. 3, the latching piece 60 assembled to the terminal module 30 comprises a pair of latch arms 63, a pair of hooks 65 extending from two edges of the two latch arms 63 respectively, a pair of transition portions 64 perpendicularly to the latch arms 63 respectively and positioned at the ends thereof, a pair of latches 61 at each end of the transition portion 64 for engaging with a mating connector and a crimping 62 at a rear end of the latch arms 63 for securing a cable.

Figure 4:
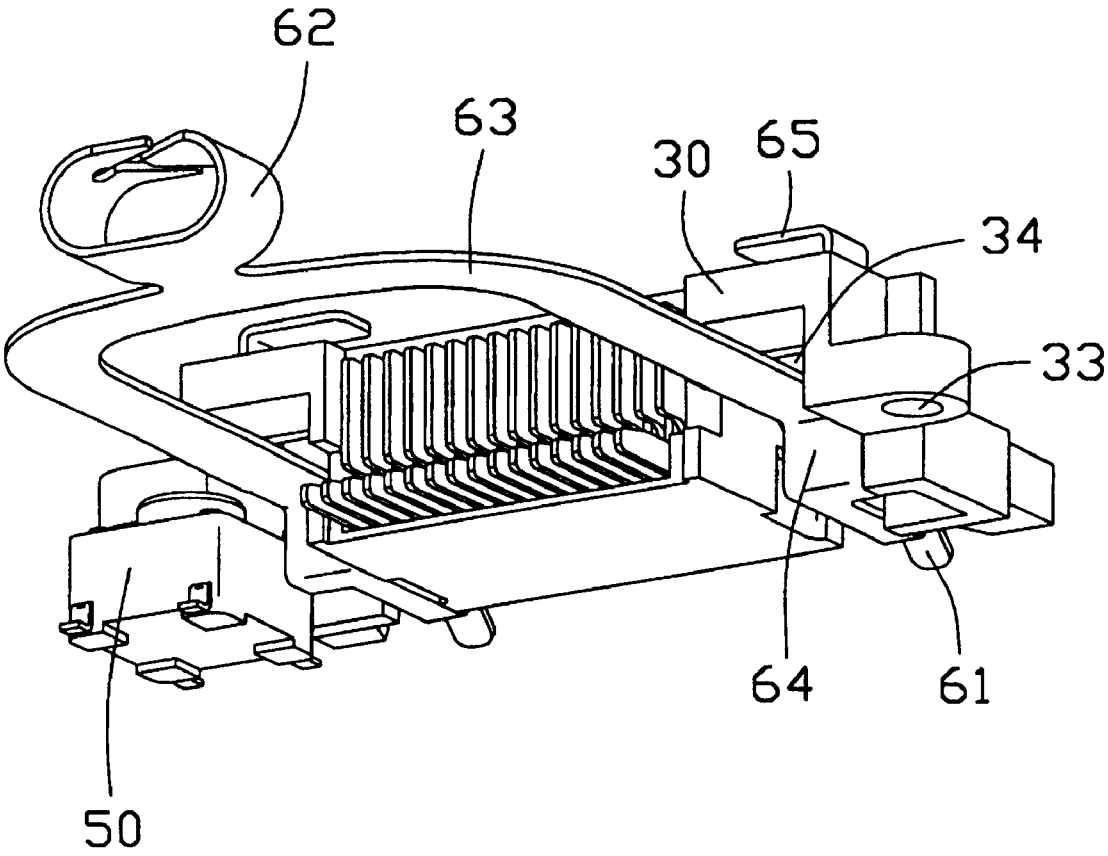
FIG. 4 is an assembly view of the latching piece FIG. 3 of and a terminal module of the electrical connector.
Figure 5:
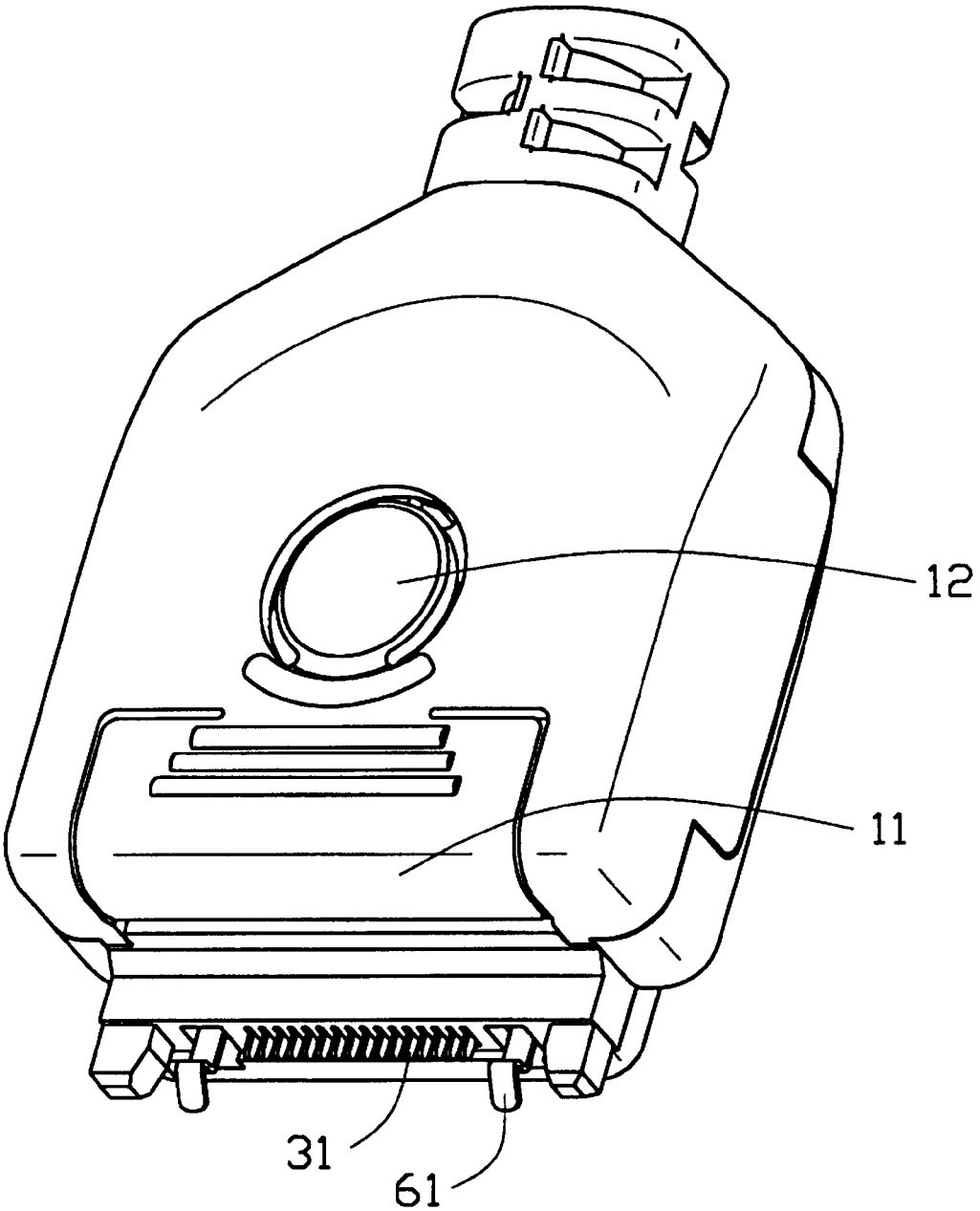
FIG. 5 is an assembled view of the electrical connector.

Referring to FIGS. 4 and 5, in assembly, the pushbutton 50 is soldered to a predetermined position of the print circuit board (PCB) 40, and the hooks 65 of the latching piece 60 through the passages 34 of the terminal module 30, and then the terminal module 30 is soldered to the predetermined position of the PCB 40. Thus, the latching piece 60 is assembled in the terminal module 30 firmly, the terminal module 30 is positioned on the bottom cover 20 by inserting a pair bolts or poles (not shown) in the upper notches 33 and the lower notches 21. Thus, the integer of the pushbutton 50, the PCB 40, the terminal module 30 and the latching piece 60 is positioned on the bottom cover 20.

The metal plate 70 is positioned on a bottom surface of the top cover 10 by engaging the central hole 72 to the central hole 16 and position notches 75 to the position poles 15, the hooks 65 of the latching piece 60 through the cavities 74 of the metal plate 70 to contact with the latch release button 14 of the top cover 10.

The top cover 10 couples to the bottom cover 20 by inserting the upper poles 13 and the lower poles 22 into the notches 82.

Figure 6:
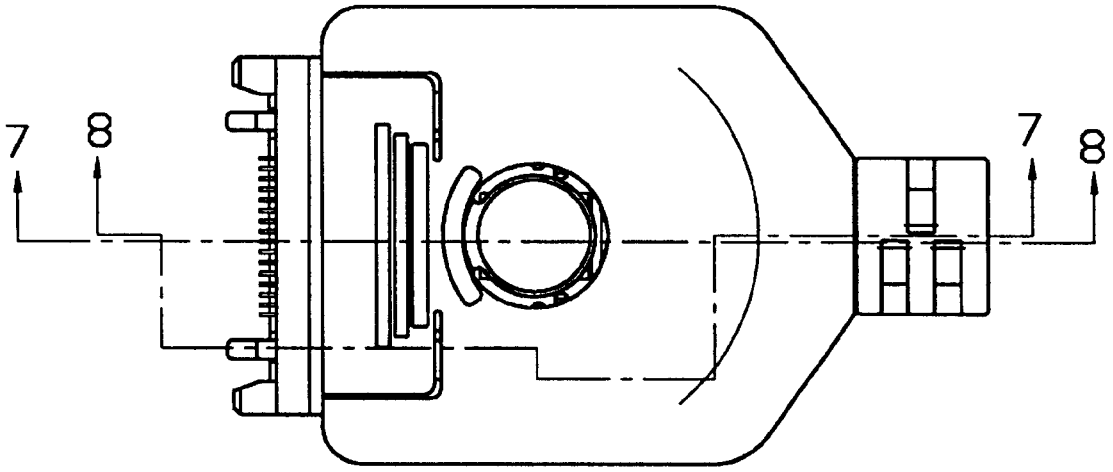
FIG. 6 is a top-view of the FIG. 5
Figure 7:
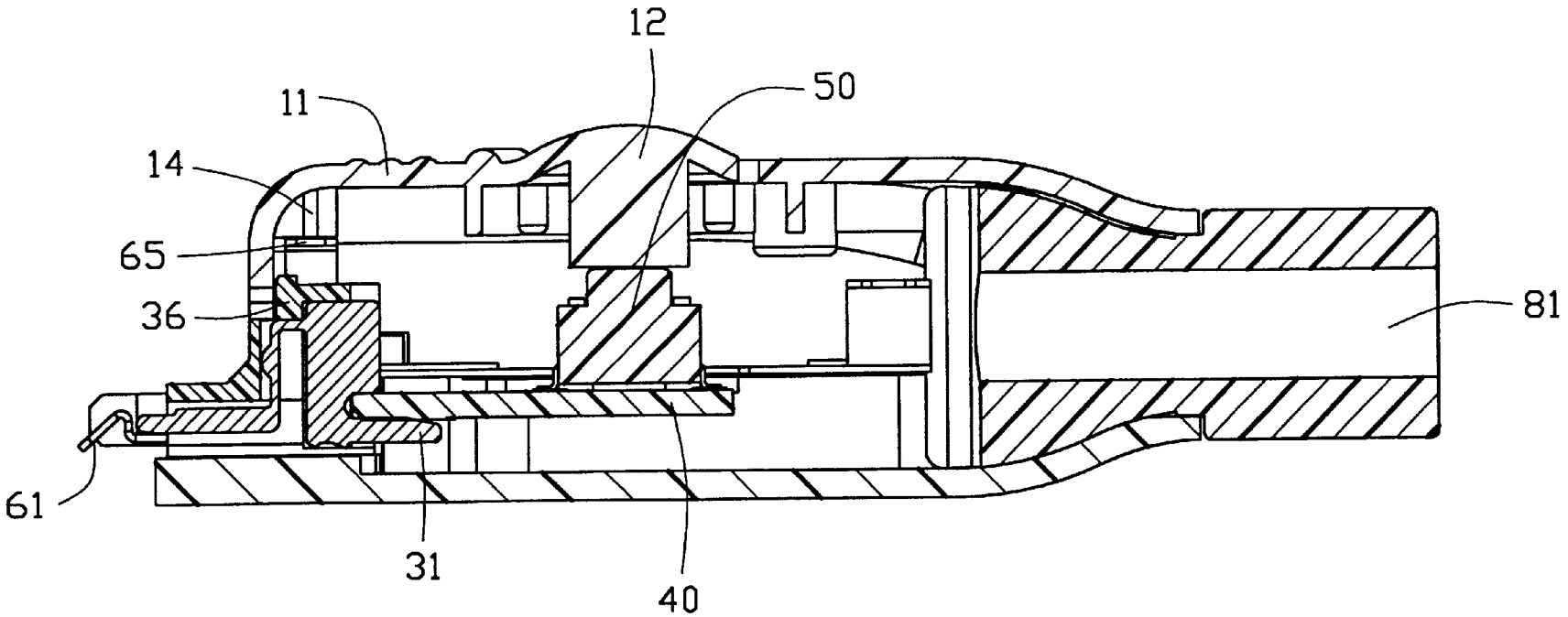
FIG. 7 is a cutaway view along line 7—7 of FIG. 6.
Figure 8:
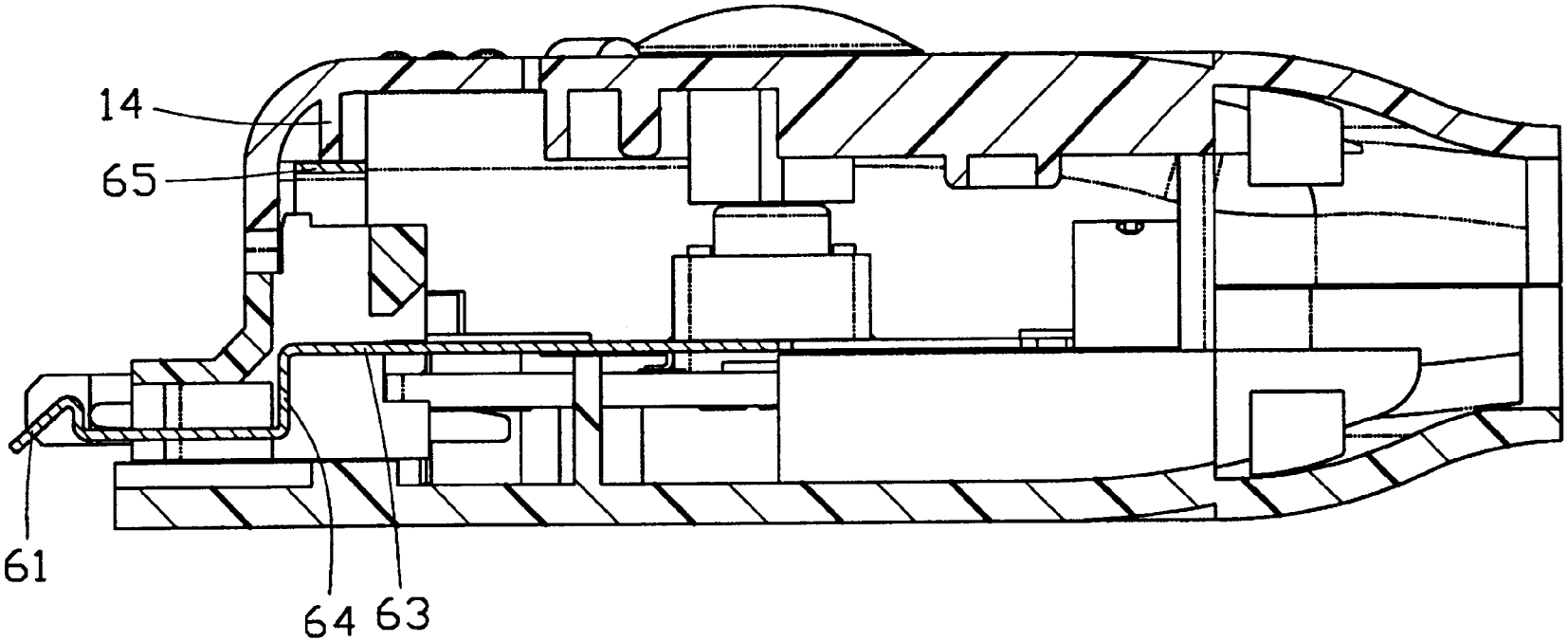
FIG. 8 is a cutaway view along line 8—8 of FIG. 6.

Referring to FIGS. 6 and 7, the step of releasing the electrical connector (1) from a mating connector (not shown) is as follow: firstly, the release button (11) is depressed and the latch release button (14) move downwardly to drive the two hooks (65); secondly, the press button (11) is released, and the hooks (65) and the bent portion (73) of the metal plate (70) spring upwardly, the latches (61) gets enough flexible force to release from the mating connector.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector comprising:

a top cover having a press button and a pair of latch release buttons protruding under the press button;

a bottom cover coupled to the top cover;

a terminal module having a plurality of terminals;

a metal plate having a base portion and a bent portion at an edge of the base portion, the bent portion having a pair of cavities;

a U-shaped latching piece assembled to the terminal module and having a pair of latch arms, a pair of latches for engaging with a mating connector, a pair of transition portions positioned perpendicularly between the latch arms and the latches, and a pair of hooks each extending from an edge of the latch arm and through the cavity of the bent portion; wherein the top cover has a plurality of position poles, and the metal plate has a plurality of position notches engaging to the position poles; wherein the top cover has a push button, and the metal plate has a central hole to retain the push button.

2. The electrical connector in accordance with claim 1, wherein the terminal module has a pair of passages positioned at two sides for receiving the transition portions of the latching piece.

* * * * *